US006851422B2

(12) United States Patent
Yeung

(10) Patent No.: US 6,851,422 B2
(45) **Date of Patent: *Feb. 8, 2005**

(54) CLEANING FLUID HEATING RESERVOIR AND MOTOR ASSEMBLY FOR A RANGE HOOD

(76) Inventor: Peter Yeung, 4446 Frances Street, Burnaby, British Columbia (CA), V5C 2R4

( * ) Notice: Subject to any disclaimer, the term of this patent is extended or adjusted under 35 U.S.C. 154(b) by 0 days.

This patent is subject to a terminal disclaimer.

(21) Appl. No.: 10/792,705

(22) Filed: Mar. 5, 2004

(65) Prior Publication Data

US 2004/0237958 A1 Dec. 2, 2004

Related U.S. Application Data

(63) Continuation-in-part of application No. 10/446,683, filed on May 29, 2003, now Pat. No. 6,712,068.

(51) Int. Cl.[7] ..... F24C 15/20

(52) U.S. Cl. ..... 126/299 E; 126/299 D; 134/167 C; 55/DIG. 36

(58) Field of Search ..... 126/299 E, 299 D, 126/299 R, 301; 454/49, 56, 62, 61, 57; 96/228, 233; 415/121.3; 55/DIG. 36; 134/115, 167 R, 167 C

(56) References Cited

U.S. PATENT DOCUMENTS

| | | | | | |
|---|---|---|---|---|---|
| 3,837,269 | A | * | 9/1974 | Sweet et al. | 126/299 E |
| 3,984,505 | A | * | 10/1976 | Gutermuth et al. | 261/111 |
| 4,460,386 | A | * | 7/1984 | Diachuk | 95/220 |
| 5,027,790 | A | * | 7/1991 | Chern | 126/299 R |
| 5,158,429 | A | * | 10/1992 | Chiang et al. | 415/121.3 |
| 5,323,762 | A | * | 6/1994 | Chiang et al. | 126/299 E |
| 5,359,990 | A | * | 11/1994 | Hsu | 126/299 E |
| 5,469,837 | A | * | 11/1995 | Chiang et al. | 126/299 D |
| 5,874,292 | A | * | 2/1999 | McMinn, Jr. | 435/262 |
| 6,662,800 | B2 | * | 12/2003 | Yeung | 126/299 E |
| 6,712,068 | B1 | * | 3/2004 | Yeung | 126/299 E |

* cited by examiner

*Primary Examiner*—James C. Yeung
(74) *Attorney, Agent, or Firm*—Paul Smith Intellectual Property Law; Paul Smith; C. Larry Kyle

(57) ABSTRACT

A cleaning fluid heating reservoir and motor assembly for a range hood having a motor housing enclosure mounted within the enclosure defined by the hood body. The heating reservoir is shaped and dimensioned to be in abutment with, or is integral with, the motor. The motor is mounted within the motor housing. The reservoir may occupy space between the top of the motor and the hood body, between the perimeter of the motor and a fan attached to the motor, or between both. Conduits connected to the heating reservoir inlet and outlet pass through the motor housing to an intermediate reservoir located within the range hood. Fluid from the intermediate reservoir is pumped to the heating reservoir and back to the intermediate reservoir thereby drawing heat energy from the motor when in operation. Cleaning fluid may also be pumped from the intermediate reservoir to areas requiring cleaning.

19 Claims, 11 Drawing Sheets

CLEANING FLUID HEATING RESERVOIR AND MOTOR ASSEMBLY FOR A RANGE HOOD

CROSS REFERENCE TO RELATED APPLICATIONS

The present invention is a Continuation-in-Part of U.S. patent application Ser. No. 10/446,683 filed May 29, 2003, now U.S. Pat. No. 6,712,068 entitled A CLEANING FLUID HEATING RESERVOIR AND MOTOR ASSEMBLY FOR A RANGE HOOD.

FIELD OF THE INVENTION

The present invention relates to range hoods for use above a cooking surface, and more particularly to a cleaning fluid heating reservoir and motor assembly for a range hood wherein cleaning fluid used to remove grease from the fans and interior of a motor housing is heated.

BACKGROUND OF THE INVENTION

Range hoods are used above cooking surfaces to remove grease, common odors and hazardous gases created during the cooking process. Typically, range hoods for domestic use have a pair of motors horizontally installed in a motor housing within the hood body. Each motor drives a fan. The fans draw air from the cooking area below and force it through the motor housing to ventilation piping.

As the vaporized grease in the entrained air travels through the motor housing, some of it condenses on the inside walls of the housing and may accumulate. It is therefore known to provide a cleaning fluid under pressure in order to clean the interior of the exhaust system.

It is also known in the art to place a refillable reservoir within the interior of the range hood so as to provide an internal supply of washing fluid. The reservoir is typically constructed of plastic in order to remove any concerns with respect to rust and is attached to the upper surface of the range hood body, towards the front of the range hood and separate from the motor housing. Fluid delivery means connected to the reservoir deliver fluid under pressure from the reservoir to the interior surfaces of the motor housing. The reservoir may be filled through a coverable hole located in the range hood exterior. Once used, the washing fluid and any grease travelling therewith drains to an external grease receptacle.

Because the reservoir is spaced apart from the motor housing, the temperature of the fluid contained within it remains at approximately room temperature. However, cleaning fluid becomes more effective at removing grease as its temperature increases. In addition, there is limited space available to accommodate the reservoir within the range hood body so its size remains limited and it must be refilled regularly.

It is therefore an object of an embodiment of the present invention to provide a range hood having an increased capacity for cleaning fluid so that the cleaning fluid reservoir need be refilled less often than those range hoods of the prior art having only a reservoir located externally to the motor housing.

It is a further object of an embodiment of the present invention to provide a range hood in which the cleaning fluid is heated above room temperature.

Other objects of the invention will be apparent from the description that follows.

SUMMARY OF THE INVENTION

According to the present invention there is provided a cleaning fluid heating reservoir and motor assembly for use in a range hood having a hood body defining an enclosure and a motor housing having top, bottom and perimeter side surfaces defining a further enclosure mounted therein. The assembly comprises a motor and a heating reservoir for cleaning fluid. The motor has a top, bottom and perimeter and is equipped with a fan. The fan and a substantial portion of the motor are contained within the motor housing. The heating reservoir is shaped and positioned substantially in abutment with a portion of said motor and has an inlet and an outlet.

In a further aspect of the invention, a portion of the heating reservoir is positioned between the top of the motor and the hood body. Alternatively, a portion of the heating reservoir is positioned between the perimeter of the motor and the fan or between both the top of the motor and the hood body and the motor and the fan.

In a further aspect of the invention, the assembly further comprises an intermediate reservoir located within the range hood body exterior to the motor housing. The intermediate reservoir is adapted to deliver cleaning fluid to the heating reservoir via the inlet.

The assembly may further comprise a pair of conduits passing through the perimeter side surface of the motor housing, a first of the pair of conduits connecting to the inlet and a second of the pair of conduits connecting to the outlet. A first is connected to the intermediate reservoir and to the first conduit for pumping fluid from the intermediate reservoir to the heating reservoir. A second pump is connected to the intermediate reservoir and to fluid delivery means for delivering cleaning fluid to the interior of the motor housing.

The heating reservoir of the assembly may comprise an outer shell defining a compartment or piping wrapped about the motor.

According to an alternative embodiment of the present invention there is provided a cleaning fluid heating reservoir and motor assembly for use in a range hood having a hood body defining an enclosure and a motor housing having top, bottom and perimeter side surfaces defining a further enclosure mounted therein. The assembly comprises a motor having an integral heating reservoir for heating cleaning fluid. The heating reservoir can be located at the top or about the periphery of the motor.

The heating reservoir has an inlet and outlet that are connectable to an intermediate reservoir located within the range hood body exterior to the motor housing.

Other aspects of the invention will be appreciated by reference to the detailed description of the preferred embodiment and to the claims that follow.

BRIEF DESCRIPTION OF THE DRAWINGS

These and other features of the invention will become more apparent from the following description in which reference is made to the appended drawings and wherein.

DETAILED DESCRIPTION OF THE PREFERRED EMBODIMENT

Figure 1:
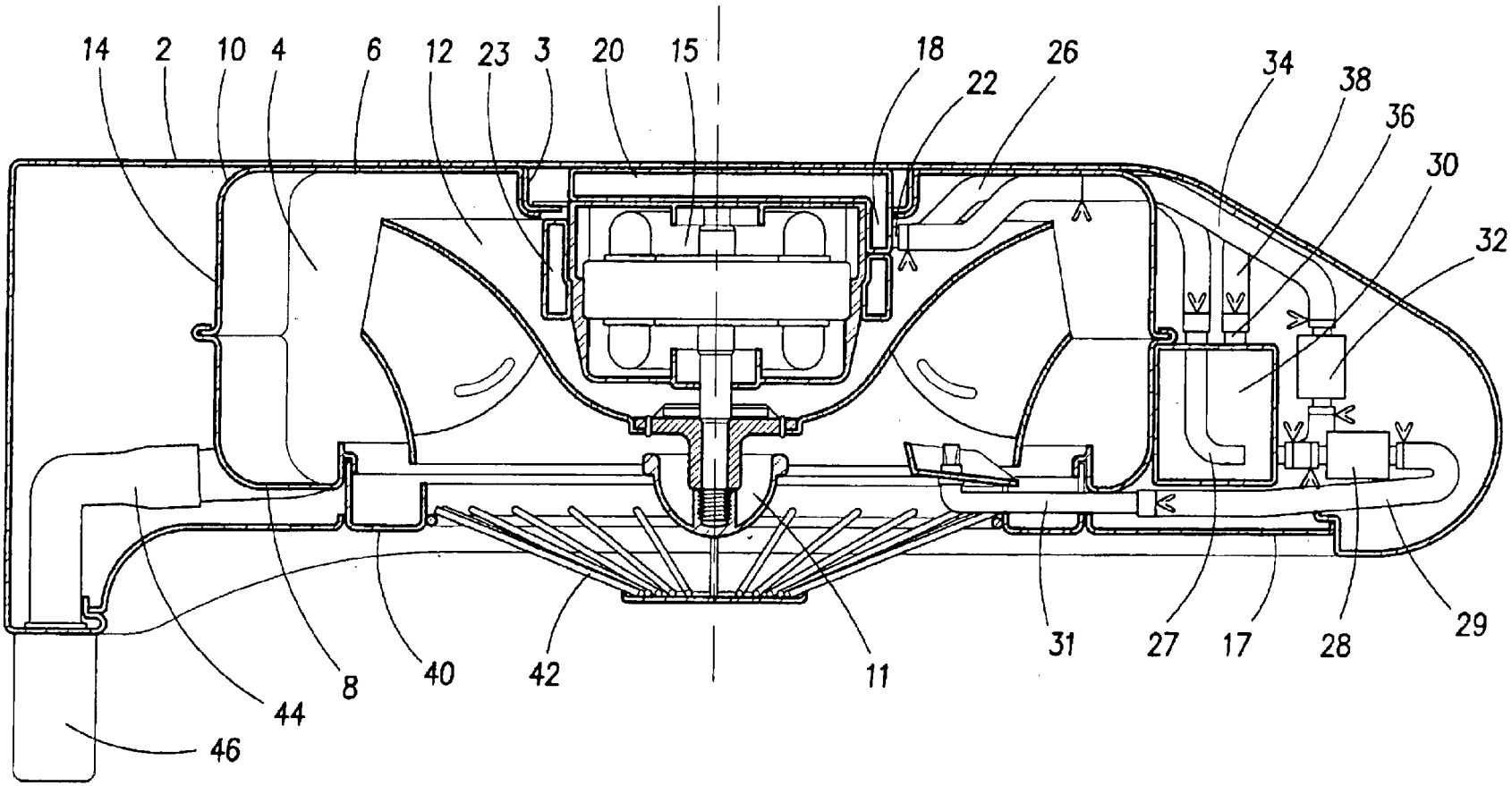
FIG. 1 is a cross sectional view of a range hood equipped with the cleaning fluid heating reservoir and motor assembly according to the preferred embodiment of the invention.
Figure 2:
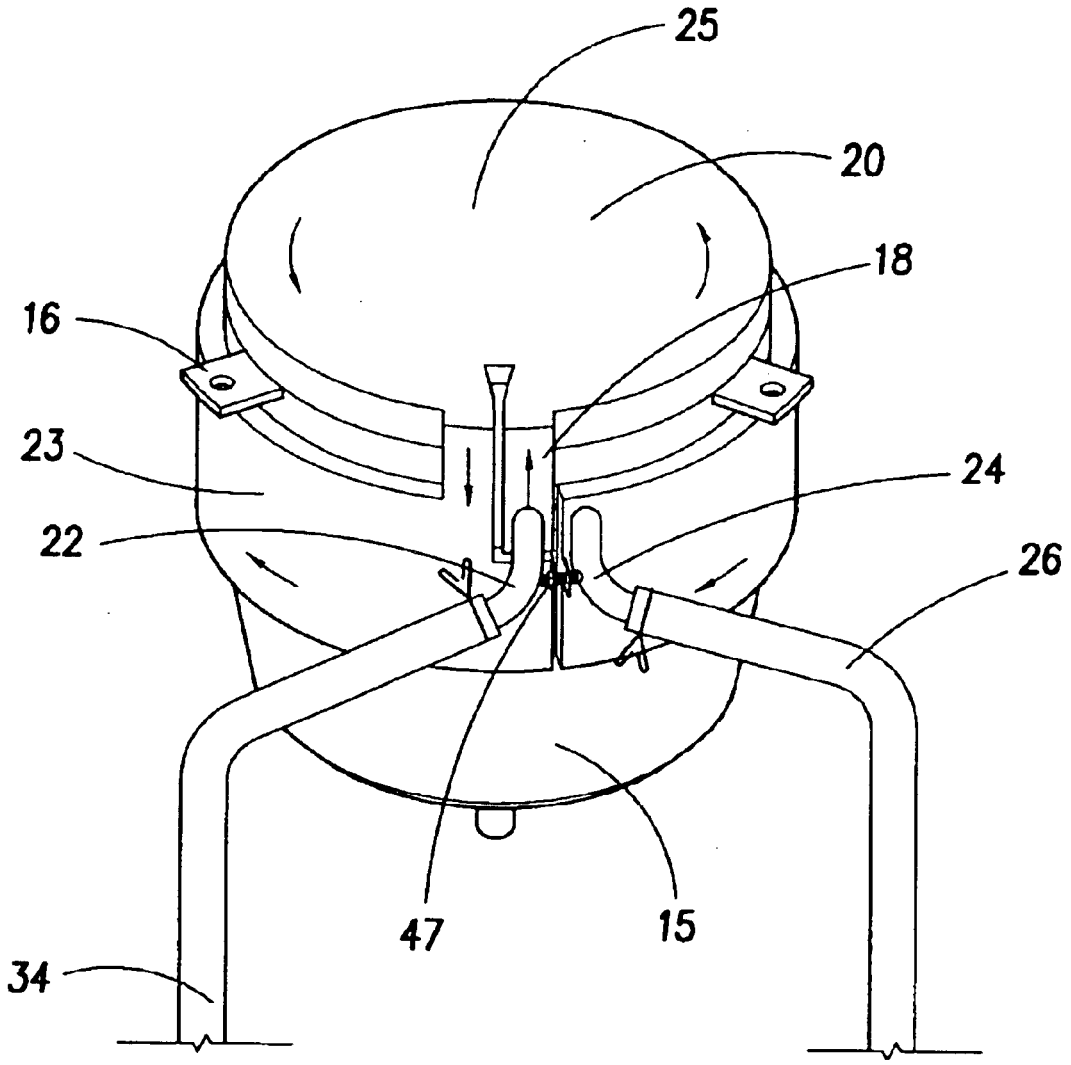
FIG. 2 is a perspective view of the cleaning fluid heating reservoir and motor assembly shown in FIG. 1.
Figure 3:
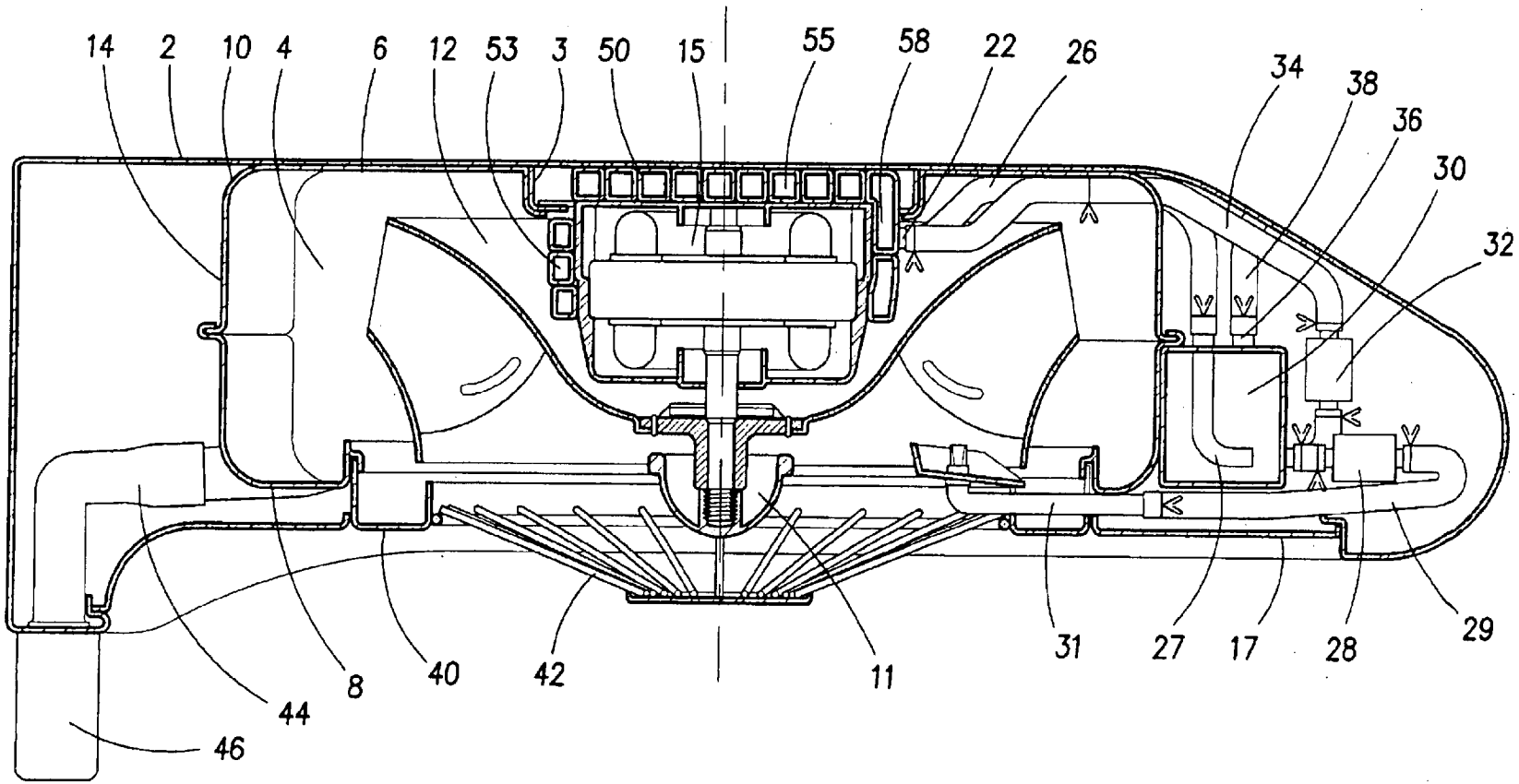
FIG. 3 is a cross sectional view of a range hood equipped with a cleaning fluid heating reservoir and motor assembly according to an alternative embodiment of the invention.
Figure 4:
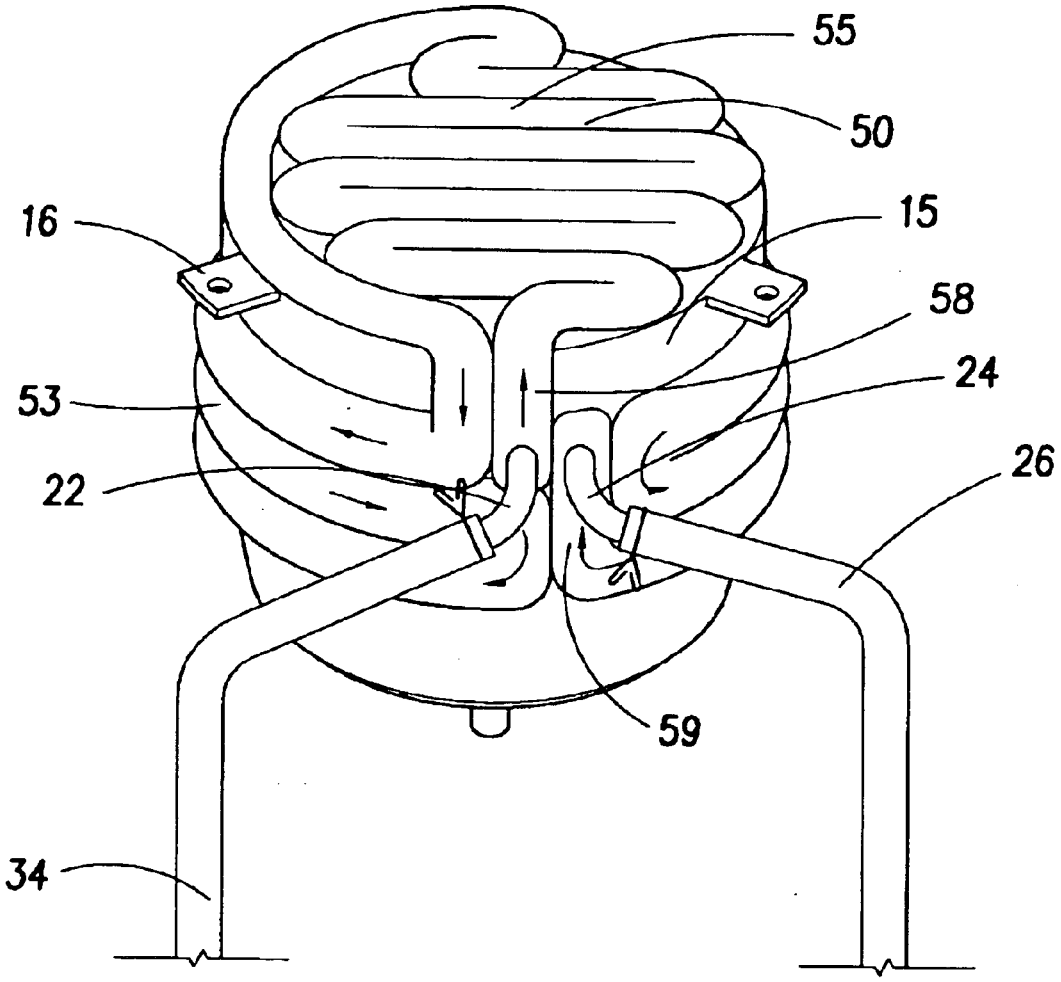
FIG. 4 is perspective view of the cleaning fluid heating reservoir and motor assembly shown in FIG. 3.
Figure 5:
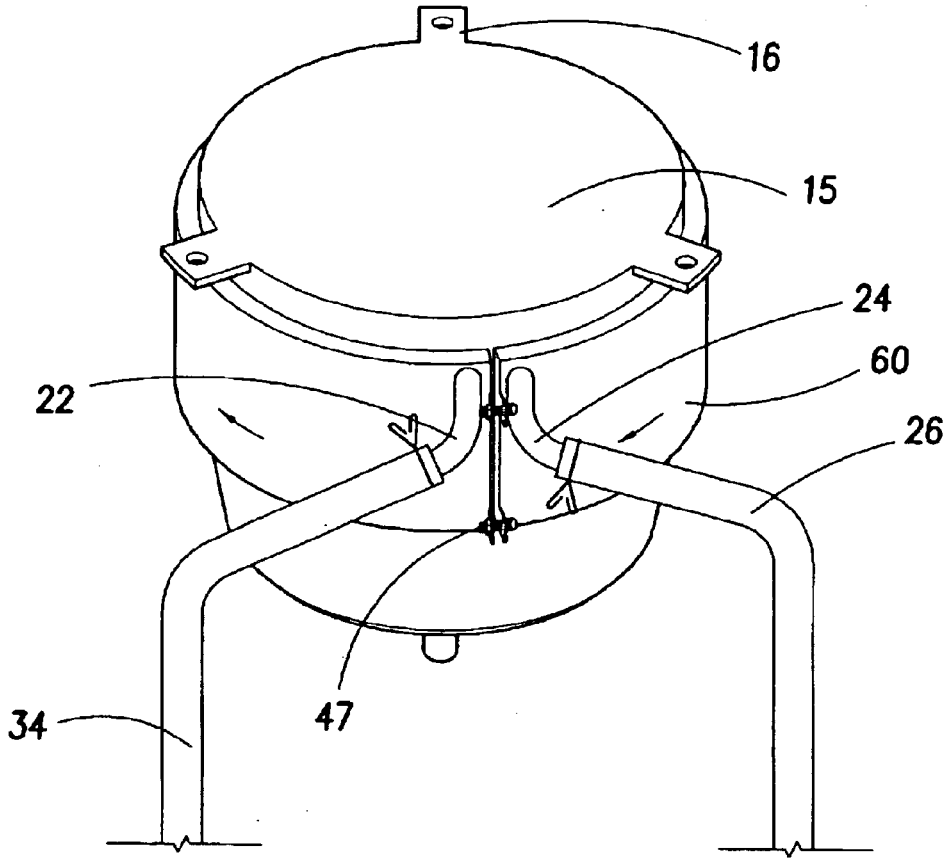
FIG. 5 is a perspective view of a further alternative embodiment of a cleaning fluid heating reservoir and motor assembly.

The preferred embodiment of range hood having a cleaning fluid heating reservoir 20 according to the invention is shown in FIGS. 1 and 2. An alternative embodiment of a cleaning fluid heating reservoir 50 is shown in FIGS. 3 and 4. Further alternative embodiments are shown in FIGS. 5 through 11.

FIG. 1 shows a range hood for mounting above a cooking surface to remove unwanted gases generated during the cooking process. A motor housing 10 defines an enclosure and is mountable within a further enclosure formed by a range hood body 2. The motor housing has a top surface 6, a bottom surface 8 and a perimeter side wall 14, which when viewed from the top of the motor housing generally defines a figure-eight. Preferably the motor housing is made of metal and is coated to prevent rust. The interior of the housing 10 may be coated with a non-stick material so as to facilitate grease removal and is separated into two substantially similar, separate chambers 4, only one of which is visible in FIG. 1.

Each respective chamber 4 has an air inlet defined in the bottom surface 8 of the motor housing 10 and a ventilation hole (not shown) defined in top surface 6. Each chamber is designed to accommodate a motor 15 having a top, bottom and perimeter and a fan 12 which act to draw hot, grease laden air from above the cooking surface, into the chamber 4 of the motor housing 10 and out the ventilation hole. The fan 12 is connected to the motor 15 by way of fan cap 11. A tray 40 may be connected to the motor housing in the area of the air inlet in order to direct air being drawn into the motor housing by the fan and to capture any grease dripping off the outer surface of the fan. A fan grill 42 prevents the insertion of objects into the fan.

The motor 15 is mounted to a bracket 3 that in turn is connected to the hood body 2, preferably by welding. Preferably screws are used to mount the connectors 16 of the motor to bracket 3 as is known in the art. After the motor is mounted in place, the motor housing 10 is also attached, also by way of screw or the like, to bracket 3.

The cleaning fluid heating reservoir 20 has a solid outer shell defining a compartment. Heating reservoir 20 is shaped so as to trace the outer contour of motor 15 as best shown in FIG. 2, with a top reservoir portion 25 and a perimeter reservoir portion 23. Heating reservoir 20 is further shaped and dimensioned so as to occupy the available space between the top of the motor 15 and the hood body 2 and between the motor 15 and the fan 12 (without coming into contact with the fan). A fastening means 47 may be used in order to ensure that the perimeter reservoir portion 23 remains in abutment with the motor 15. When the motor is mounted to the bracket 3, the top reservoir portion 25 is sandwiched between the hood body 2 and the top of the motor 15. Preferably the heating reservoir is made of a non-rusting, heat conducting metal such as copper. When the motor 15 is in operation heat is generated that is conducted through the heating reservoir 20 to the cleaning fluid contained within. In addition heated air from the cooking surface raises the temperature within the motor housing. The temperature of the heating fluid is thereby raised well above that of the normal room temperature, making it more effective at removing grease that it comes into contact with when used for cleaning purposes as discussed below.

A further intermediate reservoir 30 is located externally to the motor housing 10. Intermediate reservoir 30 may be filled by pouring cleaning fluid through an opening in the range hood body (not shown), through conduit 38 and inlet 36 into the reservoir. A pump 32 may be activated to pump cleaning fluid from the intermediate reservoir 30 through conduit 34 and inlet 22 to the entry portion 18 of the heating reservoir 20. The cleaning fluid pumped into heating reservoir 20 fills top portion 25 and perimeter portion 23 before exiting through outlet 24 and passing through conduit 26 back to intermediate reservoir 30 by way of inlet 27. Preferably inlet 27 projects into the lower interior of the intermediate reservoir so as to place heated water from heating reservoir 20 in close proximity to the outlet to spray dispensing means, which will be discussed below.

Fluid delivery means connected to the intermediate chamber 30 deliver the cleaning fluid under pressure to the interior surfaces of the range hood, in particular the motor housing. In the preferred embodiment, a further pump 28 may be activated to pump cleaning fluid from the intermediate reservoir by way of an outlet, through conduit 29 to a spray dispenser such as nozzle 31. While the spray dispenser 31 acts to spray cleaning fluid onto the fan and into the interior of the motor housing, other spray dispensers fed by pump 28 or other such pumps may be located to clean other parts of the motor housing. It is contemplated that other fluid delivery means could be used provided that the intermediate reservoir and heating reservoir be in fluid communication with cleaning fluid and that the heated cleaning fluid may be used for cleaning purposes. Used cleaning fluid, grease and other liquids within the motor housing chambers drain out through drainage hose 44 to external grease cup 46.

Preferably, the conduits 26, 29, 34, 38 are formed of heat resistant flexible hose.

Hoses 26 and 34 must pass through openings (not shown) in the side of the motor housing 10. In order to prevent any air or grease within the motor housing from passing through these openings in the motor housing, some form of seal is used, such as a rubber gasket seal. Some form of retainer may also be present to retain the hoses 26 and 34 in contact with the hood body 2 so as to avoid coming into contact with fan 12 as shown in FIG. 1

In the alternative embodiment shown in FIGS. 3 and 4, the heating reservoir 50 is in the form of piping wrapped about the top and side of the motor 15. Piping 50 is constructed of a heat conducting, non-rusting metal, preferably copper. However, any material meeting the necessary criteria (heat conducting and non-rusting) would be satisfactory. The conduit need not take the specific form of piping, but instead need only provide channels or the like within which cleaning fluid may be contained and which provides an increased surface area of heat conducting material in contact with the cleaning fluid. Components identical to those of the preferred embodiment have been identified with identical reference numbers.

Cleaning fluid from intermediate reservoir 30 is delivered by pump 32 through hose 34 and inlet 22 into piping entry 58. The cleaning fluid then courses through the top piping 55 and side perimeter piping 53 to piping exit 59 where it passes through outlet 24 and hose 26 to inlet 27 and back into the intermediate reservoir 30. Once in the piping, the cleaning fluid is heated via conduction in a similar fashion to the preferred embodiment. However, because there is more heat conducting material in relation to the volume of cleaning fluid, the cleaning fluid may be heated at a faster rate and to a higher overall temperature.

As with the preferred embodiment, the heating reservoir 50 is shaped and dimensioned to be in abutment with the motor while occupying the available space above and about the motor 15, without coming into contact with the fan 12.

Figure 6:
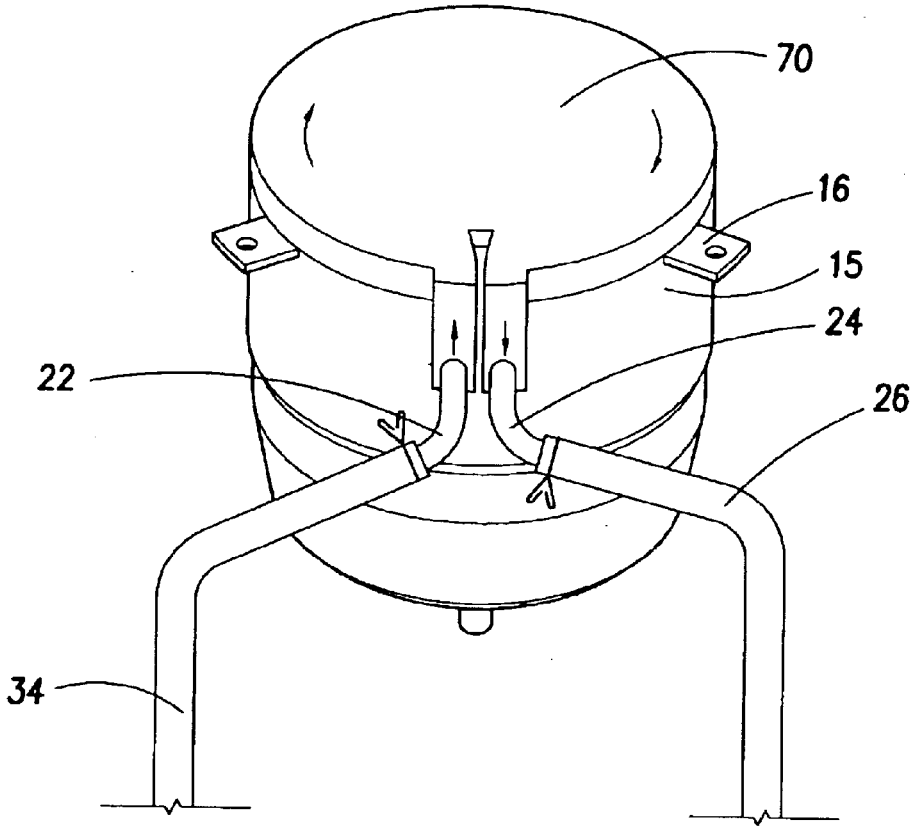
FIG. 6 is a perspective view of a further alternative embodiment of a cleaning fluid heating reservoir and motor assembly.

The heating reservoir need not be positioned above the top and about the perimeter at the same time. As shown in the alternative embodiment in FIG. 5, the heating reservoir 60 may simply be located about the perimeter of the motor 15. Alternatively, as shown in FIG. 6, the heating reservoir 70 may simply be located on top of the motor 15.

Figure 7:
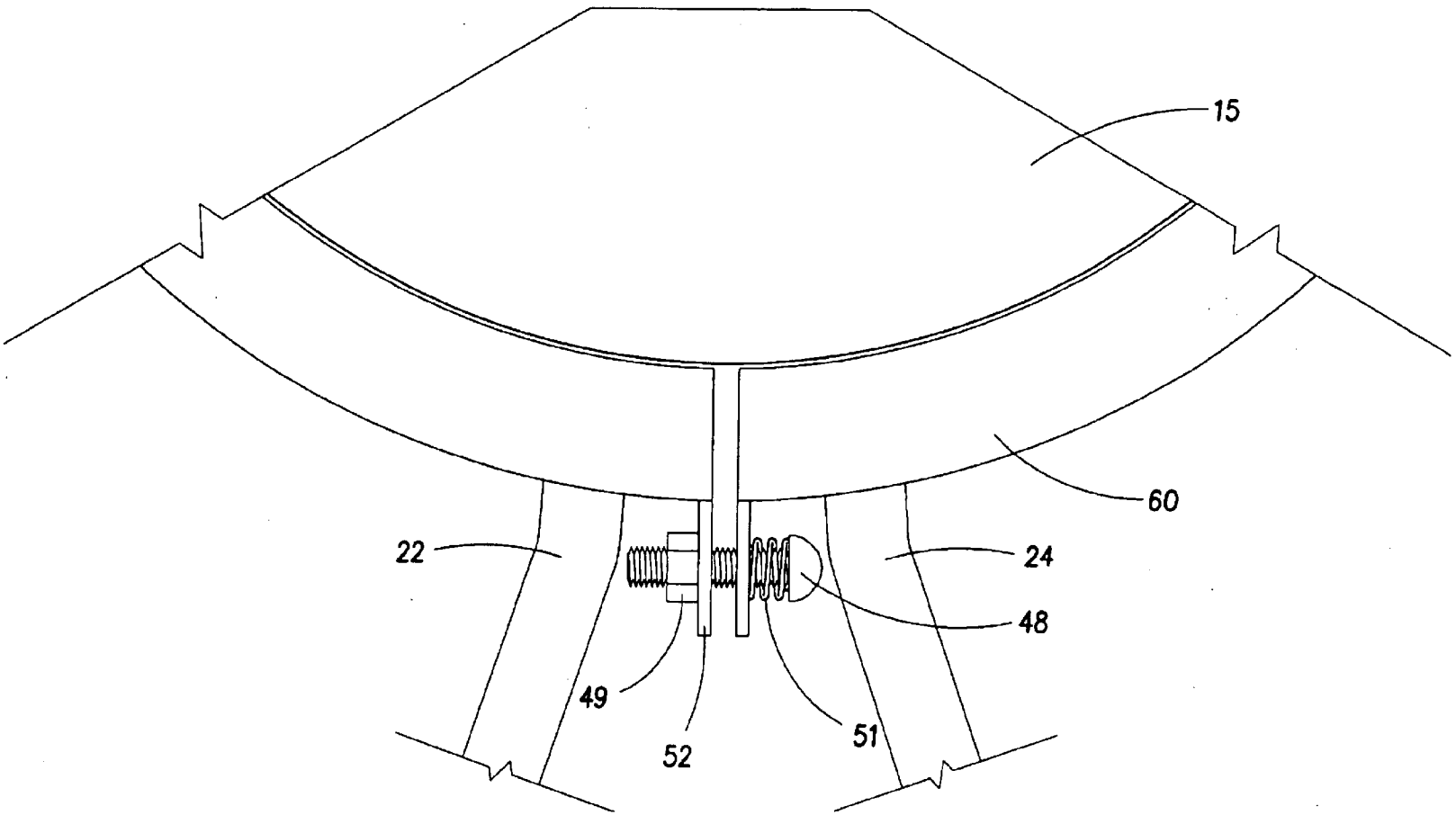
FIG. 7 is a partial top view of the cleaning fluid heating reservoir and motor assembly shown in FIG. 6 showing the fastening means.

The fastening means to retain the heating reservoir in position about the motor becomes more important when there is no top reservoir portion sandwiched between the top of the motor and the hood body to hold the perimeter portion in place. The fastening means 47 is best illustrated in FIG. 7. Preferably a pair of spaced apart flanges 52 project radially from the perimeter heating reservoir 60, one flange on the entry portion of the perimeter heating reservoir and the other located on the exit portion of the heating reservoir, the two portions being spaced apart as shown in FIGS. 6 and 7. A bolt 48 is inserted through an opening in each of the flanges 52 and connected to a nut. Preferably a spring 51 is positioned between the flange and the head of the bolt, or between the flange and the nut. The nut and bolt are tightened until the heating chamber is firmly tightened about the motor. Should the heating chamber expand as a result of heating, the spring will take up any give in the connection, thereby maintaining the heating reservoir in position about the motor.

It is also contemplated that the heating reservoir may be integrally formed with the fan motor. Examples of such further alternative embodiments where the fan motor and heating reservoir form a unitary structure are illustrated in FIGS. 8 to 11.

Figure 8:
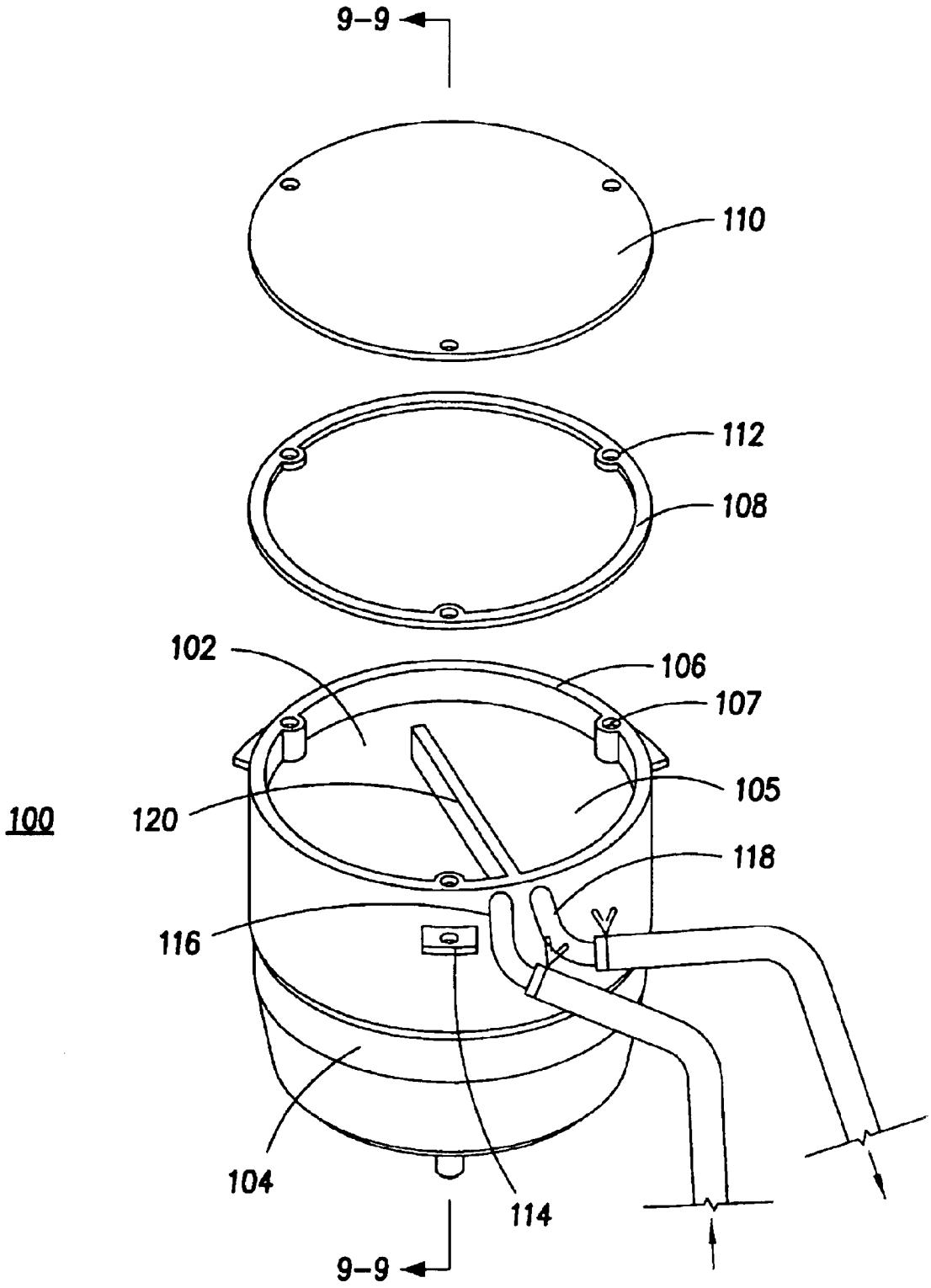
FIG. 8 is an exploded perspective view of a further alternative embodiment of a cleaning fluid heating reservoir and motor assembly.
Figure 9:
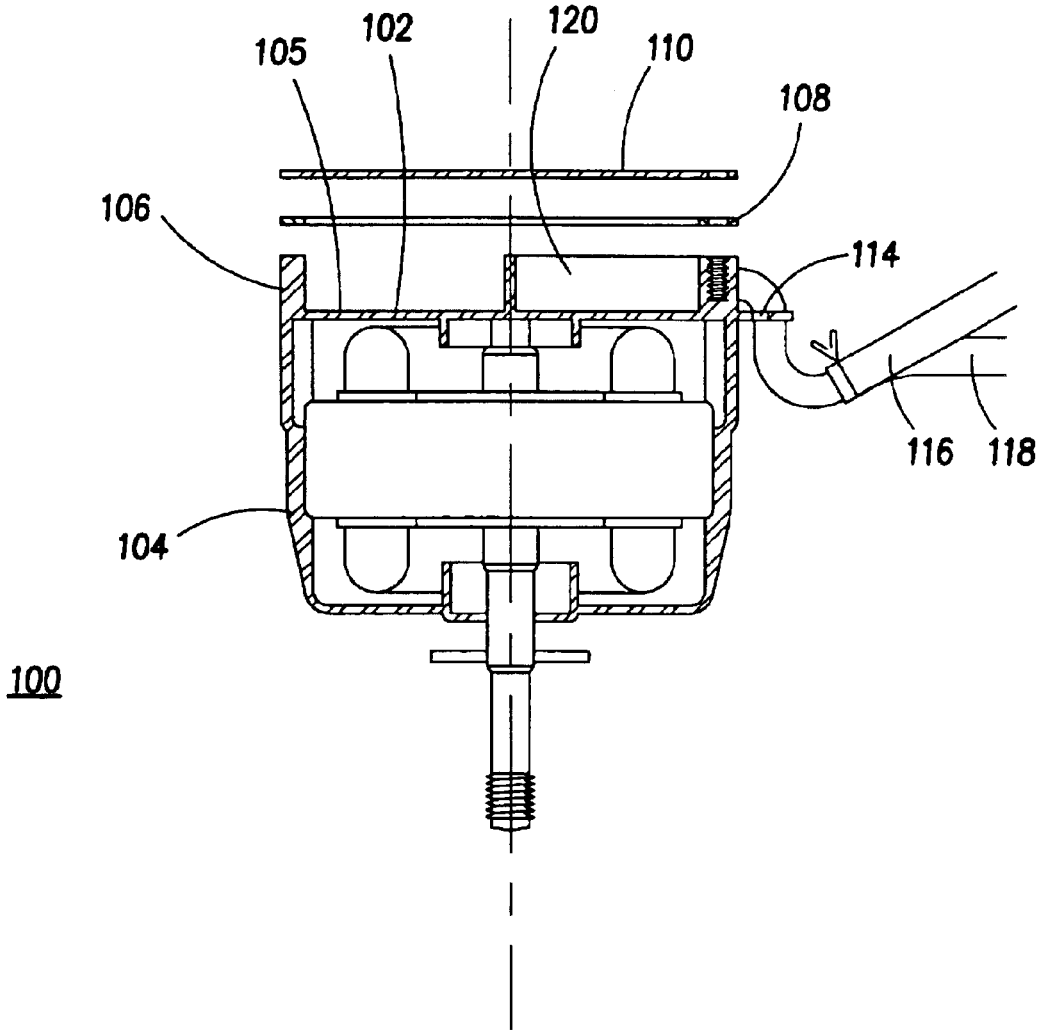
FIG. 9 is a cross-sectional view of the assembly shown in FIG. 8 taken along line 9—9.

In the embodiment shown in FIGS. 8 and 9, the fan motor 100 has an integral heating reservoir 102 having an inlet and an outlet. In this embodiment the integral heating reservoir is located at the top of the fan motor. Preferably the casing 104 of the fan motor is formed of aluminum or other heat conducting, non-rusting material and has a cylindrical wall 106 projecting above the boundary surface 105 separating the heating reservoir 102 from the motor interior. The fan motor has mounts 114 for mounting the motor to the range hood. Inlet and outlet conduits 116 and 118 are preferably positioned adjacent to, and above, one of the motor mounts 114 so as to allow for mounting of the fan motor in a range hood.

In order to ensure better circulation of the cleaning fluid within the reservoir 102, the reservoir 102 is preferably equipped with a divider wall 120. One end of the divider wall is joined to the cylindrical wall 106 between the inlet and outlet conduits 116 and 118, thereby separating the inflow and outflow of cleaning fluid into the reservoir 102. The other end of the divider wall 120 terminates prior to coming into contact with cylindrical wall 106 such that there is a gap formed therebetween. Cleaning fluid is therefore forced to circulate around the divider wall before exiting through the outlet conduit 118 to return to the intermediate reservoir.

A cover plate 110 closes off the reservoir 102. Preferably a plurality of screws (not shown) are used to secure the cover plate 110 to cylindrical wall 106 by insertion in threaded holes 107. Preferably a rubber gasket seal 108 or the like is fitted between the cylindrical wall 106 and the cover plate 110 in order to ensure a liquid-tight seal, the screws being positioned through mounting holes 112. Other methods of connecting the cover plate 110 to the cylindrical wall 106 are also contemplated, such as welding the cover plate 110 to cylindrical wall 106. Because welding ensures a liquid-tight seal, no rubber gasket would be required.

Figure 10:
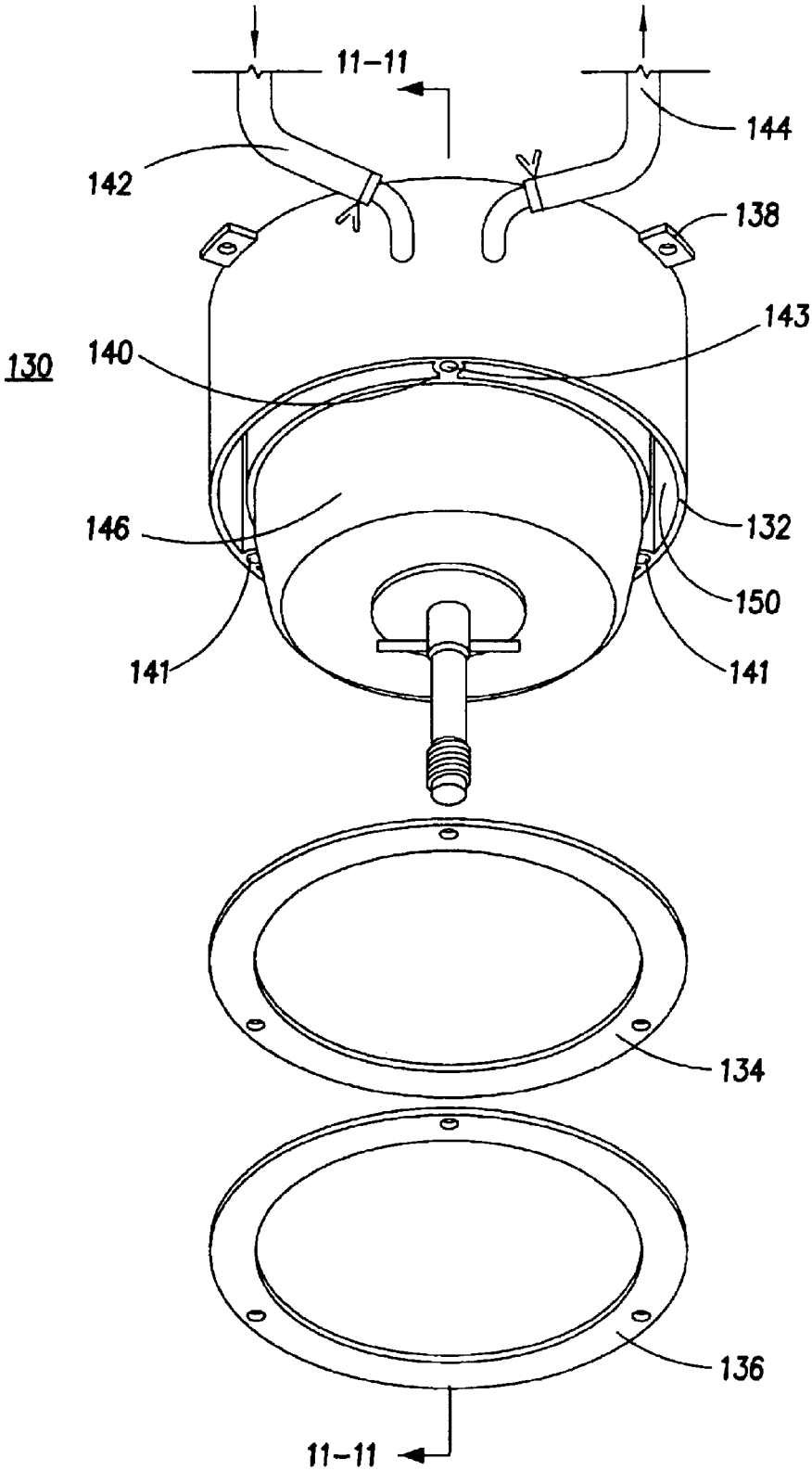
FIG. 10 is an exploded perspective view of a further alternative embodiment of a cleaning fluid heating reservoir and motor assembly.
Figure 11:
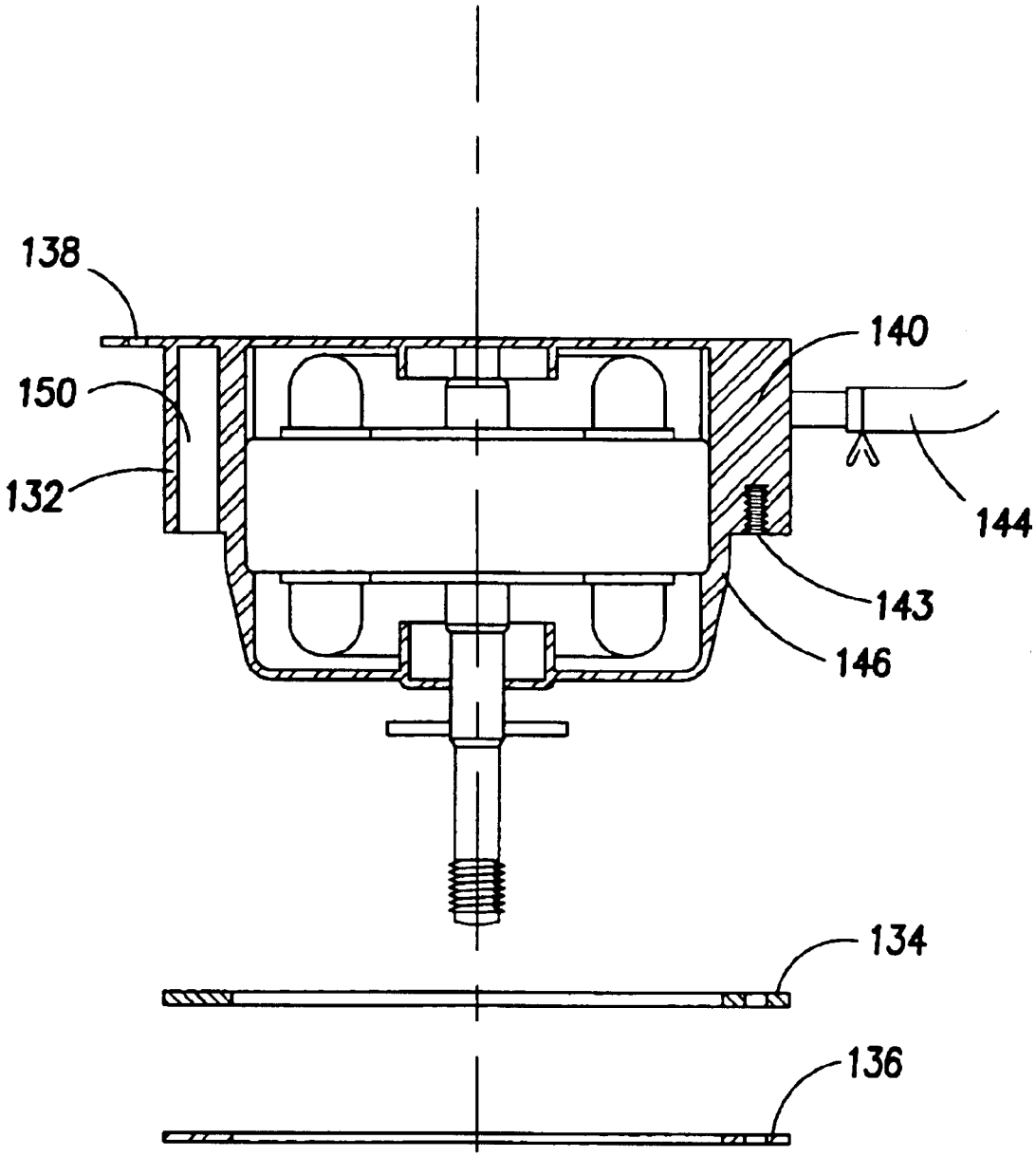
FIG. 11 is a cross-sectional view of the assembly shown in FIG. 10 taken along line 11—11.

In the embodiment shown in FIGS. 10 and 11, the fan motor 130 is equipped with an integral heating reservoir 150 that is positioned about the perimeter of the fan motor. The fan motor casing 146 is substantially cylindrical and has a plurality of motor mounts 138 positioned at the top of the motor 130 for mounting the motor to the range hood. An outer cylindrical wall 132 is spaced apart from, and integrally joined with, the main casing by way of upper cylindrical surface 135. The space between the double wall of the motor casing forms the heating reservoir 150. Preferably the reservoir 150 is sealed by mounting a cover plate 136 to the bottom of the cylindrical wall 132 by way of screws fitted into threaded holes 141 and 143. A rubber seal 134 may be utilized in order to ensure that no leaking will occur. Alternatively, as discussed above, the plate 136 may be welded to the motor casing or otherwise connected to the fan motor.

Inlet and outlet conduits 142 and 144 are connected to the heating reservoir 150 so as to circulate cleaning fluid for heating purposes. In order to ensure better circulation of the cleaning fluid within the heating reservoir 150, the heating reservoir 150 is preferably equipped with a divider wall 140 as best illustrated in FIG. 11. The inlet and outlet conduits are preferably connected to the heating reservoir 150 in close proximity to one another with the divider wall 140 positioned between them. Having the inlet and outlet adjacent opposite sides of the divider wall 140 ensures that the cleaning fluid entering heating reservoir 130 must travel about the perimeter of the fan motor before returning to the intermediate reservoir, thereby maximizing the heat transferred by conduction to the cleaning fluid from the motor.

It is also contemplated that the fan motor casing could be formed with heating reservoirs in other locations than those discussed above. The heating reservoir need simply be adapted to retain cleaning fluid, absorb heat from the fan motor, and transfer the heat to the cleaning fluid.

It is contemplated that the pumps may be controlled automatically by a programmable system or manually. Preferably, pump 32 will be activated whenever the motor 15 is turned on. In that way, a constant flow of cleaning fluid will be coursing through the heating reservoir absorbing heat energy from the conducting surface. This will act to both heat the cleaning fluid and conversely to cool the motor (heat is drawn away from it). In addition to providing heated cleaning fluid that is more efficient at removing grease, this has the added benefit of extending the useful life of the motor by reducing the temperature at which it operates.

The intermediate reservoir 30 may also be adapted to determine the temperature of the cleaning fluid contained therein. Pump 32 may also be equipped with a shut off valve so that once the cleaning fluid within the intermediate reservoir 30 reaches a specified temperature, the pump 32 shuts off. Once the temperature drops to a set temperature, pump 32 reactivates. Such a setup would help to extend the life of pump 32 by reducing the length of time that it is in operation. The pump 28 for directing fluid from the intermediate reservoir 30 to the fluid delivery means may also be activated automatically, for example after a specified number of days or range hood uses, or manually.

It is contemplated that there may be one or more intermediate reservoirs 30 and associated pumps for use in association with the two heating reservoir and motor assemblies of the range hood (one heating reservoir and motor assembly in each chamber of the motor housing).

The addition of the heating reservoirs provides additional storage area for cleaning fluid. When combined with the storage capacity of the intermediate reservoir 30, the heating reservoirs allow a range hood to contain a greater volume of cleaning fluid than the prior art designs having only cleaning fluid reservoirs located externally to the motor housing. In addition, the heating reservoirs may utilize only existing space within the range hood body, so the overall size of the range hood need not be increased in order to accommodate it.

It is contemplated that other materials such as heat resistant plastic could be used to form the non-integral heating reservoirs. While the use of plastic would not provide the same amount of heat transfer from the motor to the cleaning fluid within the heating reservoir, it is more convenient and less costly to use.

It will be appreciated by those skilled in the art that the preferred and alternative embodiments have been described in some detail but that certain modifications may be practiced without departing from the principles of the invention.

What is claimed is:

1. A cleaning fluid heating reservoir and motor assembly for use in a range hood having a hood body defining an enclosure and a motor housing having top, bottom and perimeter side surfaces defining a further enclosure mounted therein, said assembly comprising:

a motor equipped with a fan, said motor having a top, bottom and perimeter, and said fan and a substantial portion of said motor being contained within said motor housing;

a heating reservoir for cleaning fluid;

wherein said heating reservoir is integrally formed with said motor and has an inlet and an outlet.

2. The assembly of claim 1 wherein a portion of said heating reservoir being positioned at either one of, or both of, said top of said motor and said perimeter of said motor.

3. The assembly of claim 1 further comprising an intermediate reservoir located within said range hood body exterior to said motor housing, said intermediate reservoir being adapted to deliver cleaning fluid to said heating reservoir via said inlet.

4. The assembly of claim 3 further comprising a pair of conduits passing through said perimeter side surface of said motor housing, a first of said pair of conduits connecting to said inlet and a second of said pair of conduits connecting to said outlet.

5. The assembly of claim 4 further comprising a first pump connected to said intermediate reservoir and to said first conduit for pumping fluid from said intermediate reservoir to said heating reservoir and a second pump connected to said intermediate reservoir and to fluid delivery means for delivering cleaning fluid to the interior of said motor housing.

6. A cleaning fluid heating reservoir and motor assembly for use in a range hood having a hood body defining an enclosure and a motor housing having top, bottom and perimeter side surfaces defining a further enclosure mounted therein, said assembly comprising:

a motor having a top, bottom and perimeter, said motor being adapted to be mounted within said motor housing of said range hood; and a heating reservoir, said heating reservoir being adapted to retain cleaning fluid, absorb heat from said fan motor, and transfer the heat to said cleaning fluid, whereby the cleaning fluid acts as a cleaning agent for cleaning a portion of said range hood during operation.

7. The assembly of claim 6 wherein said heating reservoir is integrally formed with said fan motor.

8. The assembly of claim 7 wherein said heating reservoir has a dividing wall and an inlet and an outlet, said inlet and outlet being located adjacent to, and on opposite sides of, said dividing wall.

9. A range hood for exhausting gases above a cooking surface and having a cleaning fluid heating reservoir and motor assembly, said range hood comprising:

a hood body forming an enclosure;

a motor housing having top, bottom and perimeter side surfaces defining a further enclosure mounted within said hood body;

a motor equipped with a fan, said motor having a top, bottom and perimeter, and said fan and a substantial portion of said motor being contained within said motor housing;

a heating reservoir having an inlet and an outlet, said heating reservoir being adapted to retain cleaning fluid, absorb heat from said fan motor, and transfer the heat to said cleaning fluid, whereby the cleaning fluid acts as a cleaning agent for cleaning said range hood during operation.

10. The range hood of claim 9 wherein said heating reservoir being integrally formed with said motor.

11. The range hood of claim 9 further comprising an intermediate reservoir located within said range hood body exterior to said motor housing, said intermediate reservoir being adapted to deliver cleaning fluid to said heating reservoir via said inlet.

12. The range hood of claim 11 further comprising a pair of conduits passing through said perimeter side surface of said motor housing, a first of said pair of conduits connecting to said inlet and a second of said pair of conduits connecting to said outlet.

13. The range hood of claim 12 further comprising a first pump connected to said intermediate reservoir and to said first conduit for pumping fluid from said intermediate reservoir to said heating reservoir and a second pump connected to said intermediate reservoir and to fluid delivery means for delivering cleaning fluid to the interior of said motor housing.

14. A method of making a range hood for exhausting gases having a fan motor, the method comprising installing a heating reservoir in said range hood, said heating reservoir being adapted to retain cleaning fluid, absorb heat from the fan motor, and transfer the heat to said cleaning fluid, whereby the cleaning fluid acts as a cleaning agent for cleaning an exhaust system of said range hood during operation.

15. The method of claim 14 wherein said heating reservoir and said fan motor form a unitary structure.

16. The method of claim 14 wherein said heating reservoir is shaped to be positioned substantially in abutment with said fan motor.

17. A method of cleaning an exhaust system of a range hood having a fan motor, the method comprising:

installing a reservoir in said range hood;

providing cleaning fluid in said reservoir;

operating said fan motor, said fan motor generating heat during operation, said heat being conducted to said cleaning fluid; and delivering the heated cleaning fluid to the exhaust system of the range hood.

18. The method of claim 17 wherein the step of installing a reservoir in said range hood includes installing said reservoir substantially in abutment with a portion of said motor.

19. The method of claim 17 wherein said fan motor and said reservoir form a unitary structure.

* * * * *